United States Patent [19]

Peche et al.

[11] 4,015,172

[45] Mar. 29, 1977

[54] TWO PATH VOLTAGE ARRESTER

[75] Inventors: Gerhard Peche; Gerhard Lange, both of Berlin, Germany

[73] Assignee: Siemens Aktiengesellschaft, Berlin & Munich, Germany

[22] Filed: Mar. 17, 1975

[21] Appl. No.: 559,224

[52] U.S. Cl. ..... 361/129; 313/188; 313/217

[51] Int. Cl.[2] ..... H01J 17/04

[58] Field of Search ..... 317/61, 62, 69, 70; 313/188, 217

[56] References Cited

UNITED STATES PATENTS 3,818,259 6/1974 Schleimann-Jensen ..... 317/62 X

*Primary Examiner*—Harry Moose

*Attorney, Agent, or Firm*—Hill, Gross, Simpson, Van Santen, Steadman, Chiara & Simpson

[57] ABSTRACT

A two path overvoltage arrester comprising two frustum-shaped main electrodes which have facing portions forming planar electrode surfaces facing toward each other and which are mounted into opposite ends of a tubular insulator member which also has a ring electrode mounted at its center and wherein both sides of the ring electrode as well as the planar electrode surfaces of the main electrodes are provided with relatively thin ring shaped attachments so as to provide hollow electrodes into which can be inserted an activation material.

3 Claims, 3 Drawing Figures

TWO PATH VOLTAGE ARRESTER

BACKGROUND OF THE INVENTION

1. Field of the Invention

The present invention relates to an overvoltage arrester having two frustum-shaped main electrodes which are sealed into the ends of a tubular insulator member and with their planar electrode portions forming active electrode surfaces and facing each other and wherein the tubular insulator is divided at its center by a metallic ring electrode so as to form two discharge paths with the main electrodes.

2. Description of the Prior Art

Over voltage arresters utilizing two symmetrically mounted frustum-shaped electrodes mounted in a sealed manner into opposite ends of a tubular insulator member are well known. Such voltage arresters are called knob arresters and are generally of small dimensions. It is common practice to mount a metallic ring in the center between the frustum-shaped electrodes so as to form a ring electrode in order to form two discharge paths between the ring electrode and the two frustum-shaped electrodes and such over voltage arresters are called two-path over voltage arresters.

It is also known to strengthen the electrodes of an over voltage arrester at the point of the arc initiation so as to obtain good heat removal characteristics. In certain multi-pole over voltage arresters the electrodes are connected to form a part of the wall of the discharge containers so that they may be suitably cooled.

It has also been known in two path arresters to apply a thin layer of particles of a non-conductive or semi-conductive material to the main electrodes so as to encourage the start of discharge at a low voltage.

SUMMARY OF THE INVENTION

The present invention provides a two-path over voltage arrester which will have long life and its reaction characteristics are very satisfactory.

The present invention solves the problem of the prior art in that the ring electrode has surrounding its center opening on both sides thereof narrow metallic rings and further the main electrodes are surrounded by narrow metallic rings such that the ring electrode and the main electrodes form hollow electrodes and further such hollow electrodes are provided with an activation layer.

An over voltage arrester in accordance with this invention has the advantage that a large amount of electrode activating material is stored in the hollow electrodes without causing the material to move or to be consumed due to the existance of an arc and thus the direct breakdown voltage which depends upon the particular pressure as well as the distance between the metallic rings which are connected by soldering or welding on opposite sides of the ring electrode and the main electrodes will not vary. It is to be realized, of course, that the active electrode material on the surface of the main electrodes and the ring electrodes also effects the breakdown voltages.

The width of the ring which is soldered or welded to the center electrodes as well as the main electrodes is generally of the same order of magnitude as the thickness of the frames which are supporting the rings and generally the rings are made of iron. The outer diameter of the metallic rings correspond to the diameter of the planar active electrode surfaces of the main electrodes. It is particularly advantageous if the outer diameter of the metallic rings is larger than the diameter of the planar portion of the active electrode surfaces of the main electrodes. With such dimensioning a low breakdown voltage may be obtained for two-path over voltage arresters according to the invention. The planar active electrode surfaces of the main electrodes can be corrugated or formed in waffle shape so as to increase the adherence of the electrodeactivation layer.

It has proven to be particularly advantageous to embody the over voltage arrester of this invention into a tubular metallic frame into which the insulated portion of the arrester is received. The invention provides that the tubular insulator member of the outer margins of the external side has ring-shaped shoulders or flanges which are aligned with the end planes of the electrodes so that a protrusion which exceeds the outer diameter of the electrodes is formed in the center part of the insulator member and an insulating gap is formed between the protruding ends with the plane of the electrodes adjacent the tubular frame.

Since the cylindrical insulator member has a larger diameter than the electrode external surfaces, and the over voltage arresters contained in metallic tubular frame members may be protected by the frame against a short circuit of the electrodes. In those cases where a hard-solder connection is made between the metallic insulator member and the outside surfaces of the electrodes, the insulator member will be recessed near on each side of the solder ring connection position or is substantially strengthened, so that the solder margins cannot touch the tubular frame. The voltage breakdown of the gap formed must be greater than the direct breakdown voltage of the voltage arrester mounted in the conducting frame since an electrode on the outside usually carries the potential of the tubular frame member. If the direct reaction voltage of the over voltage arrester increases, the diameter of the insulator member must be increased with respect to the largest outside diameter of the electrode which protrudes from the insulating member. The external air gap resulting in the case of tubular frames can be utilized as an auxiliary spark path in which the direct reaction voltage is above that of the over voltage arrester but within the perscribed protection level of the design. Since the pressure of the gas within the over voltage arrester is generally only a small fraction of atmospheric air pressure, the direct breakdown voltage will increase in the case of overloaded voltage arresters in which the seal has been broken or which are leaking, however the upper limit of the voltage breakdown can be maintained because of the external auxiliary spark path.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1:
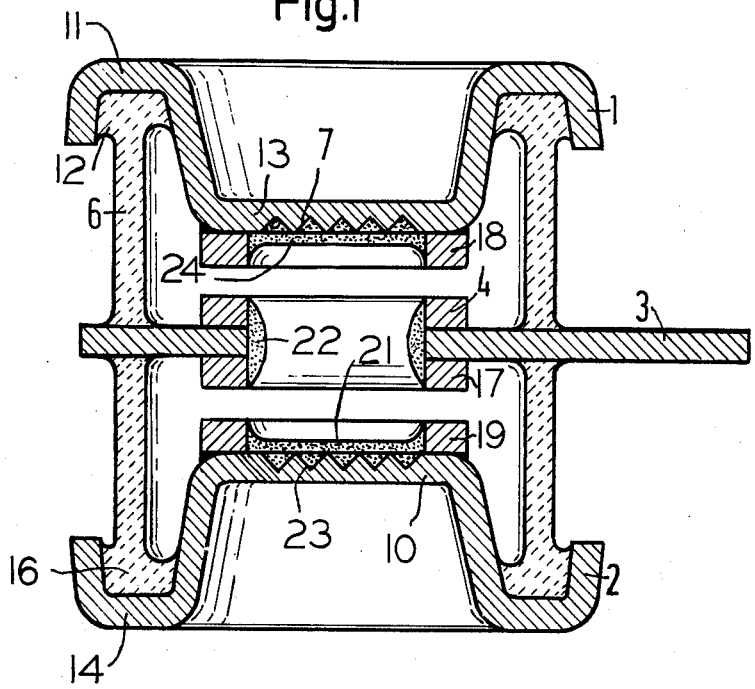
FIG. 1 is a sectional view of an over voltage arrester according to the invention.

FIG. 1 illustrates the over-voltage arrester of the invention which comprises two frustum-shaped main electordes 1 and 2 which made a seal with opposite ends 12 and 16 of a tubular insulator member 6. Note, for example, that the ends 12 and 16 mate with recesses 11 and 14 formed in the main electrodes 1 and 2. The insulator member 6 may be made of ceramic or glass and may be divided at its center by a center ring-shaped electrode 3 which extends through the walls of the insulator in a gas sealed manner. Within the confines of the insulator member 6, the ring electrode 3 is formed with an opening and on the opposite sides of such opening ring members 4 and 17 are attached. The main electrodes 1 and 2 are formed with planar electrode portions 10 and 13 to which rings 19 and 18 are respectively attached so as to form hollow electrodes facing each other and facing the ring electrode 3. Layers of activation material 21 and 24 are mounted within the rings 19 and 18 of the main electrodes and activation material 22 is mounted on the inside of the annular electrode 3 and the rings 4 and 17 as shown.

The planar surface 10 and 13 of main electrodes 2 and 1 may be roughened or formed with corrugations or waffle-like surfaces 23 and 7 as shown.

The rings 18 and 19 may be formed by punching and are soldered or welded to the main electrodes in a known manner. The rings 4, 17, 18 and 19 have rectangular cross-sections, as shown.

Figure 2:
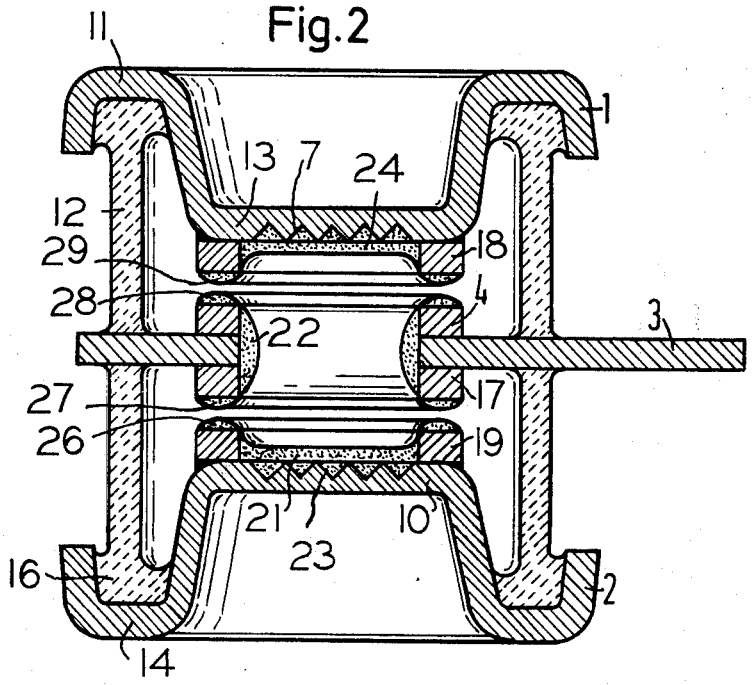
FIG. 2 is a sectional view of a modified form of the invention.

FIG. 2 is a slight modification of the structure of FIG. 1 wherein the activation layer is also formed on the facing surfaces of rings 18 and 19 and the rings 4 and 17. For example, activation material 26 is attached to ring 19 and activation material 27 and 28 are attached to the faces of rings 17 and 4 which are adjacent the main electrodes. The ring 18 has activation material 29 on its edge which faces the ring 4.

Figure 3:
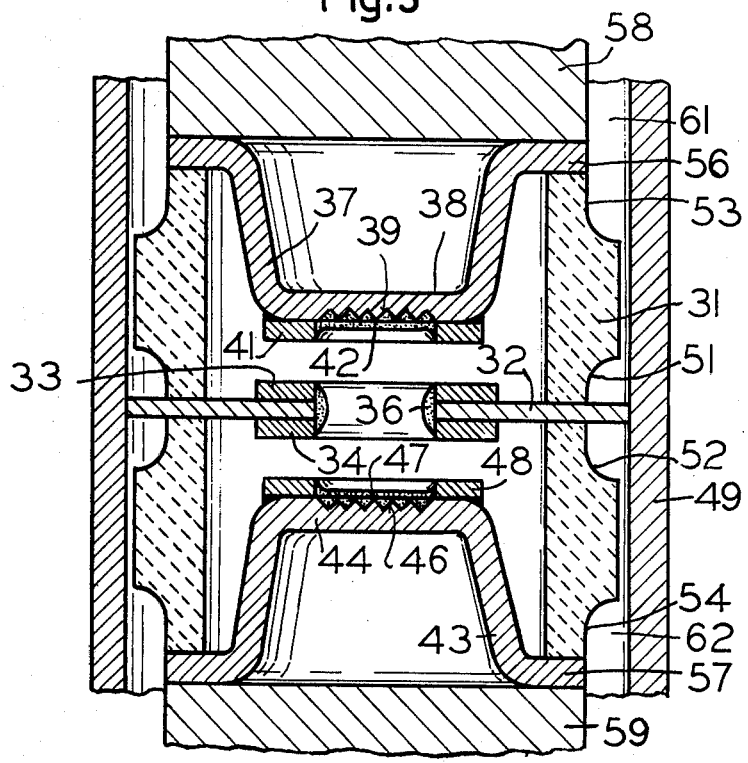
FIG. 3 is a sectional view of an over voltage arrester utilizing a metallic tubular frame member surrounding the over voltage arrester.

FIG. 3 illustrates a modification of the invention mounted within a conducting metallic tubular member 49. A center metallic ring-shaped electrode 32 has its opposite ends connected to the walls of tubular member 49 and passes through the walls of an insulating tubular member 31 in a gas sealed manner as shown. Ring electrodes 33 and 34 are attached to opposite sides of the electrode 32 about its central opening and activation material 36 is mounted within the center opening of the rings 33 and 34 and the ring electrode 32. Main electrodes 37 and 43 are attached to opposite ends of the insulating tubular member 31 and have center facing planar electrode portions 38 and 44. A narrow metallic ring 41 is attached to the planar portion 38 of main electrode 37 and a narrow metallic ring 48 is attached to the planar portion 44 of electrode 43. The surfaces 39 and 46 of the planar portions 38 and 44 are roughened and activation material 42, 47 and 36 are mounted in the main electrodes 37 and 43 and the center electrode 32.

The activation materials 21, 22, 24, 26, 27, 28 and 29, 36, 42 and 47 are made of a material of high electron emission capability.

The insulating member 31 adjacent the center electrode 32 is formed with shoulders 51 and 52 as shown so that annular shaped gaps are formed between the insulator 31 and the outer tubular member 49 on opposite side of the ring electrode 32. Since the outer edges of the ring electrode 32 are connected to the tubular member 49, it will be at the same electrical potential as the member 49 which under most operating conditions would be at ground potential.

The tubular insulator member 31 is formed with annular shoulders 53 and 54 adjacent its opposite ends and the outer edges of the electrodes 37 and 43 which are designated respectively, 56 and 57 are flushed with the outer edges of the shoulders 53 and 54 as shown. This structure provides gaps 61 and 62 between the ends 56 and 57 of the electrode 37 and 43 and the tubular conducting member 49.

Large cylindrical supporting contact members 58 and 59 are attached to the main electrodes 37 and 43 as shown and are insulated from the tubular member 49.

It is seen that this invention provides a new and novel over voltage arrester and although it has been described with respect to preferred embodiments, it is not to be so limited as changes and modifications may be made therein which are in the full intended scope as defined by the appended claims.

We claim as our invention:

1. An over voltage arrester comprising:

an insulating tubular member, a pair of main electrodes mounted and sealed to opposite ends of said insulating tubular member, a central electrode attached to said tubular insulating member between said main electrodes and with a central opening and forming two discharge paths therewith, four metallic rings with two of said rings attached to the facing surfaces of said pair of main electrodes and two other of said rings attached to opposite sides of said central electrode about said central opening, activation material mounted on said main electrodes within said two rings and activation material also mounted on the inside of said central openings of said central electrode and said other two rings, and wherein said tubular insulator member mounted in said tubular frame member and formed with a pair of ring-shaped shoulders and positioned at the centers of said planar portions of said main electrodes so that protrusions exceeding the outer diameters of said main electrodes are formed in the center part of said insulator member and insulating gaps are formed between said shoulders and said tubular frame.

2. An over voltage arrester according to claim 1 wherein a pair of large contacts are attached to each main electrode and at least one contact insulated from said tubular frame member and aligned with the outer edge of the associated main electrode.

3. An over voltage arrester according to claim 2 in that the tubular insulator member is formed with a ring-shaped shoulder at the outer margin in the area of said ring electrode.

* * * * *